US012742548B2

(12) United States Patent
Knieser et al.

(10) Patent No.: US 12,742,548 B2
(45) Date of Patent: Sep. 22, 2026

(54) SYSTEMS AND METHODS FOR AUTOMATED FURNACE INDUCER SENSOR OUTPUT VERIFICATION

(71) Applicant: Rheem Manufacturing Company, Atlanta, GA (US)

(72) Inventors: Michael John Knieser, Fishers, IN (US); Robert A. Oglesbee, Fishers, IN (US); Stephen Maciulewicz, Lady Lake, FL (US)

(73) Assignee: Rheem Manufacturing Company, Atlanta, GA (US)

( * ) Notice: Subject to any disclaimer, the term of this patent is extended or adjusted under 35 U.S.C. 154(b) by 524 days.

(21) Appl. No.: 18/361,318

(22) Filed: Jul. 28, 2023

(65) Prior Publication Data

US 2024/0044490 A1 Feb. 8, 2024

Related U.S. Application Data

(60) Provisional application No. 63/370,180, filed on Aug. 2, 2022.

(51) Int. Cl.
*F23N 3/08* (2006.01)

(52) U.S. Cl.
CPC ..... *F23N 3/085* (2013.01); *F23N 2223/08* (2020.01); *F23N 2225/04* (2020.01); *F23N 2227/16* (2020.01); *F23N 2231/20* (2020.01); *F23N 2233/08* (2020.01); *F23N 2235/30* (2020.01); *F23N 2239/04* (2020.01); *F23N 2241/02* (2020.01)

(58) Field of Classification Search
CPC ..... F23N 3/085
USPC ... 126/110 E, 110 D, 110 C, 110 B, 110 AA, 126/110 A, 104 A; 431/18
See application file for complete search history.

(56) References Cited

U.S. PATENT DOCUMENTS

2004/0043345 A1* 3/2004 Jaeschke ..... F23N 3/08 431/18
2010/0280665 A1* 11/2010 Fildes ..... F24H 9/2035 700/275
2018/0087775 A1* 3/2018 Mullin ..... F23N 3/085

* cited by examiner

*Primary Examiner* — Vivek K Shirsat
(74) *Attorney, Agent, or Firm* — Eversheds Sutherland (US) LLP

(57) ABSTRACT

Disclosed are systems and methods for automated furnace inducer sensor output verification. A furnace may include a sensor, such as a transducer, that may be used to measure pressure within the furnace (for example, pressure resulting from the operation of a draft inducer blower and/or any other component of the furnace). It is possible that the data produced by the sensor may remain relatively fixed for a given period of time. However, this makes it difficult to determine if the data is valid or if the sensor is malfunctioning. Given this, an algorithm is used to change a motor speed of the inducer blower. The subsequent data that is produced by the sensor is then monitored to determine if an expected change in the data occurs. If the change does not occur, then it may be determined that the sensor is malfunctioning.

20 Claims, 4 Drawing Sheets

SYSTEMS AND METHODS FOR AUTOMATED FURNACE INDUCER SENSOR OUTPUT VERIFICATION

CROSS-REFERENCE TO RELATED APPLICATION(S)

This application claims priority to and the benefit of U.S. Provisional Application No. 63/370,180, filed on Aug. 2, 2022, the disclosure of which is hereby incorporated herein by reference in its entirety.

TECHNICAL FIELD

The present disclosure relates generally to systems and methods for automated furnace inducer sensor output verification, and, more particularly, to systems and methods for verifying the accuracy of data being produced by a transducer when the data produced by the transducer remains unchanged over a given period of time.

BACKGROUND

A furnace is a component of a heating, ventilation, and air conditioning (HVAC) system that is used to provide warm air throughout an environment, such as a residential home or a commercial building, for example. A furnace may include an inducer blower that has a motor that spins a set of blades to pull air across the gas flame nozzles in the furnace to regulate the amount of air in the burning fuel and air mixture. Secondarily, the inducer blower may pull the resulting flame down the heat exchanger tubes. The inducer blower thus improves combustion efficiency. The operation of the inducer blower may be controlled by a control board (which may be referred to as a "controller" herein) of the furnace.

A furnace may also include one or more inducer sensors used to capture data relating to the operation of the inducer blower. For example, the one or more sensors may include pressure transducers that may be used to measure the pressure within the inducer blower. In some instances, multiple sensors may be used, with the sensors comprising a collection of pressure switches, with each sensor set to a different pressure value. However, any other number and/or combination of different types of sensors may also be used. The inducer pressure transducer generates either a digital or analog result. This data may be representative of air movement and/or pressure that the inducer blower is creating. However, in some cases, there may be a period of time where the sensor data remains unchanged. In such cases, it may be unclear if the unchanged data is actually accurate data or if the sensor is malfunctioning.

Figure 1:
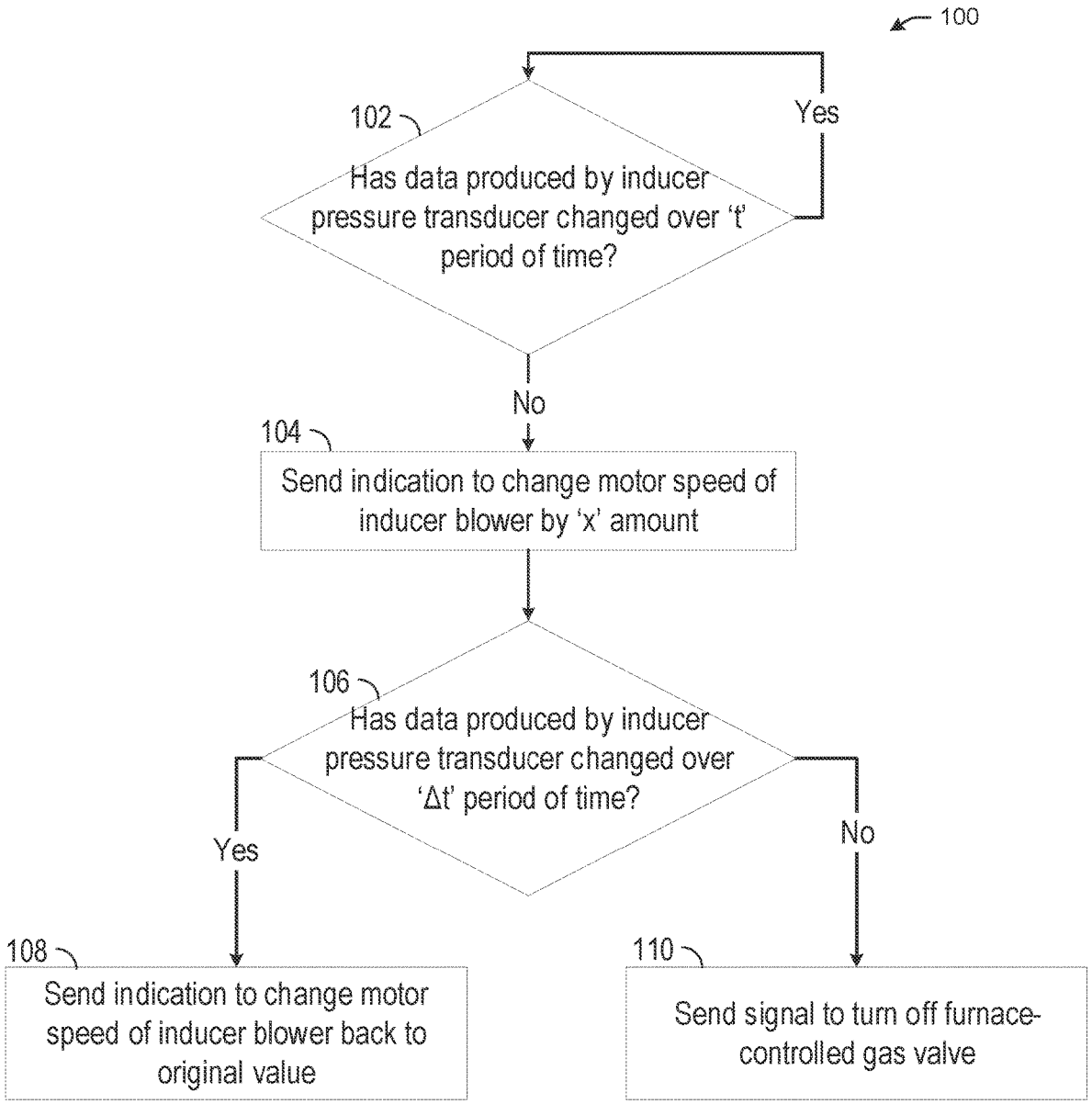
FIG. 1 is an example flow diagram, in accordance with one or more embodiments of the disclosure.

The detailed description is set forth with reference to the accompanying drawings. The drawings are provided for purposes of illustration only and merely depict example embodiments of the disclosure. The drawings are provided to facilitate understanding of the disclosure and shall not be deemed to limit the breadth, scope, or applicability of the disclosure. The use of the same reference numerals indicates similar but not necessarily the same or identical components; different reference numerals may be used to identify similar components as well. Various embodiments may utilize elements or components other than those illustrated in the drawings, and some elements and/or components may not be present in various embodiments. The use of singular terminology to describe a component or element may, depending on the context, encompass a plural number of such components or elements and vice versa.

DETAILED DESCRIPTION

This disclosure relates to, among other things, systems and methods for automated furnace inducer sensor output verification. Particularly, the systems and methods may involve an algorithm that is used to determine if the data produced by an inducer pressure transducer included in a furnace is valid. While reference is made herein to an inducer pressure transducer, the systems and methods may also be applicable to any other type of transducer (or any other type of sensor) as well. Additionally, the same type of algorithm may also be applicable in other contexts beyond a furnace.

Figure 2:
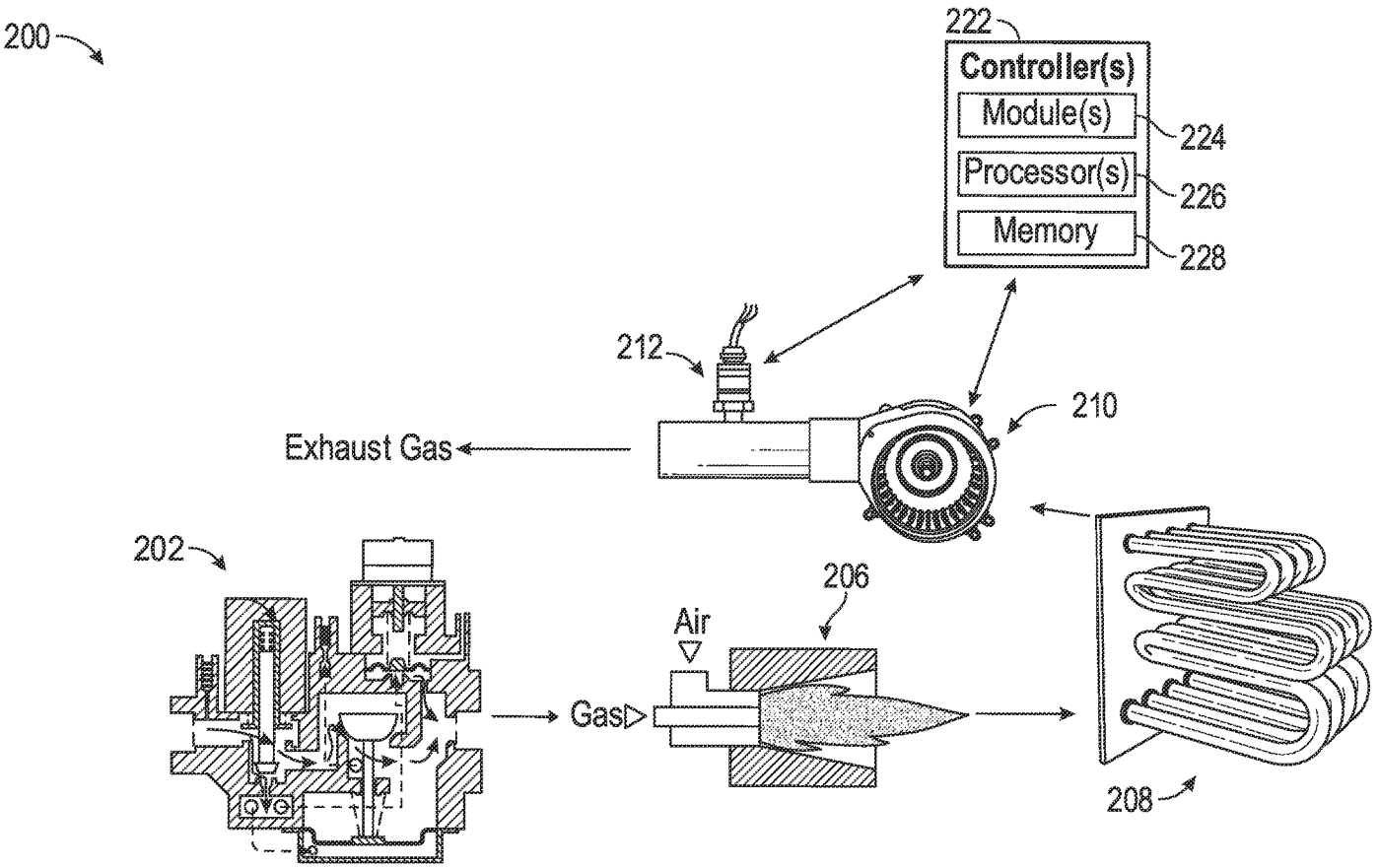
FIG. 2 is an example furnace system, in accordance with one or more embodiments of the disclosure.

In some configurations (for example, as illustrated in FIG. 2, a furnace may include one or more inducer pressure transducers to measure the pressure within the furnace at any given time. In a steady-state operating condition, a controller of the furnace may instruct the inducer blower within the furnace to operate at a fixed fan speed to cause a consistent rate of airflow through the furnace. In such steady-state conditions, the inducer pressure transducer may be generating actual measurements that are "mostly" fixed. Measurements being "mostly" fixed may entail that sometimes the actual measurement results will vary, or be noticeably different, however, there may be times when that actual measurement does not vary. During these periods where the actual measurements do not vary, it may be unclear if the pressure transducer is producing actual data that is not varying or if the pressure transducer is simply not functioning as intended. Since the inducer pressure transducer is indirectly measuring the operation of the inducer blower, it is important to know if the reported result from the inducer pressure transducer is an actual measurement or a fictitious measurement caused by some adverse event.

Thus, to allow the furnace controller to differentiate between valid data that is simply non-varying and invalid data, an algorithm may be used to force a change in the furnace operation that would normally result in a noticeable change in the inducer pressure transducer data. Based on the resulting data that is obtained after the forced change, it may be determined if the data being produced by the inducer pressure transducer is valid. For example, if the data obtained from the inducer pressure transducer remains constant after the forced change is enacted, then it may be determined that the data produced by the inducer pressure transducer is invalid. Likewise, if the data obtained changes after the forced change is enacted, then it may be determined that the data produced by the inducer pressure transducer is valid and the data actually was constant during the given period of time.

More specifically, the algorithm may involve the following operations. First, it may be determined that the data produced by the inducer pressure transducer has not changed for a pre-determined period of time. This determination may not necessarily be limited to the data being an exact constant value, but may also consider data that remains within a given set of bounds as well (for example, a change within 1% of the value, 5% of the value, and/or any other bounds). Additional information regarding the parameters used to trigger the data verification (for example, the amount of time, the amount of change in the data, etc.) may be described with respect to at least the flow diagram 100 of FIG. 1.

Once it is determined that the data produced by the inducer pressure transducer has not changed for the pre-determined period of time, the furnace controller may send a signal to adjust the motor speed of the inducer blower by a given amount. This change in motor speed may be a pre-determined value that should result in a measurable change in the data being produced by the inducer pressure transducer.

A given amount of time after the motor speed of the inducer blower has been adjusted, the data being produced by the inducer pressure transducer may be checked for any noticeable change in value. This "noticeable change" may refer to a pre-determined amount of change that is expected to occur given the pre-determined adjustment to the motor speed of the inducer blower. However, this definition of a noticeable change is not intended to be limiting. For example, in some cases, the noticeable change may also simply refer to any change in the data being produced by the inducer pressure transducer as well.

To provide an illustrative example, three pressure switches may be used and set to three different inducer blower operational points. For example, the pressure switches may be set to one of the following: 0.35, 0.4, 0.55, 0.75, 0.93 and/or 1.0 inches of water. These pressure switches may be called the low pressure cut-off switch (LPC), the medium pressure cut-off switch (MPC) and the high pressure cut-off switch (HPC). Assignment of the switch cut-off could be as follows: LPC may be set of 0.4 inches of water, MPC may be set to 0.75 inches of water and HPC may be set to 1 inch of water. Additionally, an inducer blower motor may have a RPM speed range from 1500 to 4700. In this case, a motor RPM of 1880 may be needed to trip the LPC, a motor RPM of 2820 may be needed to trip the MPC and a motor RPM of 3760 may be needed to trip the HPC. The pressure transducer output may produce a unique value for each of these pressure settings. If the pressure transducer produced a ratiometric 0 to 5 DC voltage output over the pressure range of 0 to 4 inches of water, the pressure transducer may be expected, for example, to output 0.5 DC Volts at 0.4 inches of water, 0.94 DC Volts at 0.75 inches of water and 1.25 DC Volts at 1 inch of water.

Continuing the example, a 10% increase in the RPM may be used to verify the pressure transducer operation (however, any other increase or decrease may be used as well). Thus, 1880 RPM for the LPC may change to 2068 RPM. This may translate to a 10% change in the transducer output voltage. Thus, the transducer may output 0.55 DC Volts. The controlling microprocessor's analog-to-digital converter (ADC) may recognize a 0.05 Volt change. If the microprocessor uses 12-bits ADC and the microprocessor can read analog signals from 0 to 5 volts, then the output ADC values may be a number ranging from 0 to 4096 where 0 may be 0 DC Volts and 4096 may be 5 DV Volts. Therefore, a 0.5 Volt input to the ADC may generate a value of 410. In addition, a 0.55 DC Volts may generate a value of 450. Thus, a 10% RPM change may produce a noticeable ADC output change of about 40. If this change is observed, the sensor may be determined to be functioning correctly. This is merely one example illustration of how data may be validated and the process, any example values, and/or any other portion of the example is not intended to be limiting in any manner. If no noticeable change in the data has occurred, or an unexpected change has occurred, then it may be determined that the inducer pressure transducer is not producing valid data. In such cases, an action may be taken to ensure the effective operation of the furnace. For example, a furnace-controlled gas valve may be turned off and the furnace may enter a safe state with respect to furnace heating. However, if an expected noticeable change is observed in the data produced by the inducer pressure transducer, then the motor speed of the inducer blower may be returned to the previous motor speed, and the furnace may continue to operate.

This algorithm may not only be used to identify currently malfunctioning sensors, but may also be used to proactively identify future conditions associated with the furnace as well. For example, iterating through this verification process several times and identifying several points at which a sensor is failing may indicate that the sensor is likely going to need to be replaced in the near future. Additionally, over time the static pressure in the furnace might change for a given setting. This information may be used by the controller to monitor the furnace and determine if the furnace getting old or obstructed (which may cause a failure of the furnace). Over time, the prognostic may inform a user the system is functioning poorly and an alert could be sent to inform an owner, and/or service personnel, that the system may require maintenance or replacement.

Turning to the figures, FIG. 1 is an example use flow diagram 100, in accordance with one or more embodiments of the disclosure. The flow diagram 100 depicts high-level operations that may be performed in association with the algorithm that is used to verify if a sensor is producing valid data. Particularly, if an inducer transducer is producing valid data relating to the operation of an inducer blower in a furnace. In some cases, the inducer sensor may specifically be a pressure transducer that may be used to measure the pressure within the furnace. Any of the operations may be performed by a controller associated with the furnace (for example, the one or more controllers 222 illustrated in FIG. 2 and/or any other controller or computing element). While reference may be made herein to an inducer sensor and an inducer blower, this is not intended to be limiting, and the flow diagram 100 may also be applicable to any other type of sensor and/or component of a furnace, and/or even sensors and/or components in contexts other than furnaces as well.

The flow diagram 100 begins with condition 102. Condition 102 may involve a determination as to whether data produced by the inducer sensor has changed over a given period of time. If it is determined that the data has changed over the period of time, then the flow diagram 100 returns to condition 102 to continue monitoring the data produced by the sensor. That is, the controller may determine that the inducer sensor is operating as intended and is producing valid data. If it is determined that the data has not changed over the period of time, then the flow diagram 100 proceeds to operation 104.

The period of time may be a predetermined amount of time that is established by the algorithm itself and/or manually established by a user. For example, a user may determine that consistent sensor readings for a period of 10 minutes at a time is a sufficient threshold for triggering verification of the validity of the sensor data. However, any other period of time may also be used, such as a number of seconds, minutes, hours, days, and/or any other amount of time. The user may also be able to adjust this threshold amount of time at any point.

As another example, the algorithm may automatically determine the threshold period of time that may be used. The algorithm may make this determination in any number of different ways, such as through the use of historical data relating to the furnace being monitored and/or data relating to any other furnaces as well. The algorithm may also be capable of adjusting the period of time, such that the period of time may be dynamic. For example, a feedback loop may exist in the algorithm that may allow the algorithm to fine-tune the exact period of time that is used. The period of time that is used may also vary depending on certain factors, such as the historical operation of the specific sensor, the type of sensor, the type of furnace, the environment in which the furnace exists, the specific type of inducer blower, and/or any other factors that might impact the operation of the furnace. These dynamic adjustments, in some instances, may be made using artificial intelligence, machine learning, or any other type of model. Such models may be trained over time using historical data that is provided to the model and based on real-time inputs captured by the model as a particular furnace is monitored.

Additionally, the lack of change in data that triggers the flow diagram 100 to proceed to operation 104 may not necessarily require an exactly constant data output. For example, an error threshold may be established. Even if the data output produced by the sensor changes slightly over time, if the changes are within the error threshold, then the flow diagram 100 may still proceed to operation 104. This error threshold may also be established by a user and/or automatically established by the algorithm and may also be dynamic as well.

After the determination in condition 102 that the data has not changed over the period of time, operation 104 involves sending an indication to enact a change in the furnace that should result in a change in the data outputs produced by the sensor. In this manner, it may be determined based on subsequent data produced by the sensor if the sensor is operating as intended and the lack of change in the data was the result of valid data that simply remained constant, or if the lack of change was actually indicative of a malfunctioning sensor. Particularly, the change may include sending an indication (for example, by the controller) to adjust a speed of the motor of the inducer blower by a certain amount. However, the adjustment may also include any other type of adjustment based on the particular type of sensor that is being verified, and the recitation of the inducer blower is not intended to be limiting.

The amount of change that is introduced to the motor speed to perform the data verification may be any amount of change. Generally speaking, the amount of change may be sufficiently large enough that a measurable amount of change in the data produced by the sensor should result. However, the amount of change may also be limited such that the change is not so large that the functioning of the furnace may be impaired.

The amount of change may be a value that is manually established by a user (such as a service technician, for example) or automatically established by the algorithm. Additionally, the amount of change may be dynamic and may change over time depending on factors such as the age of the furnace and any components in the furnace, the environment in which the furnace exists, and/or the specific types of components included in the furnace (for example, the specific sensor and inducer blower that are used, etc.), for example. In this manner, the amount of change may vary between individual furnaces as the components used within each furnace and the environment in which each furnace exists may vary.

Following operation 104, the flow diagram 100 proceeds to condition 106. Condition 106 involves a determination as to whether the data produced by the inducer sensor has changed over a given period of time. If it is determined that the data has changed, the flow diagram 100 proceeds to operation 108. If it is determined, however, that the data still has not changed even after the adjustment is enacted, then the flow diagram 100 proceeds to operation 110.

The specific amount of change that triggers the flow diagram 100 to proceed to operation 108 may vary. In some cases, the algorithm may be established to identify any change in the data at all (or any change that exceeds the aforementioned error threshold). However, in some cases, a more specific amount of change may be sought. For example, a change in a speed of the motor by 'x' amount should result in an expected 'y' change in the data produced by the sensor. This is because there should be a known relationship between the motor speed of the inducer blower in normal operation and the readings produced by the sensor as a result. The exact change in data produced by the sensor given the change in the motor speed of the inducer blower may be referenced in any number of ways. For example, a look-up table may be employed that may include various motor speeds and expected associated sensor readings. However, the exact change in sensor readings may also be determined in any other manner as well.

Additionally, the condition 106 may not necessarily only be limited to determining if a given amount of change has occurred in the data, but may also monitor for scenarios where the data does change, but changes by an unexpected amount. For example, the motor speed of the inducer blower may be changed by a certain amount that should result in an expected decrease in pressure as indicated by subsequent data. The subsequent data may indicate a decrease in pressure within the furnace, but may indicate a much larger decrease than expected. In this case, although the pressure decrease was registered by the data, the amount of decrease may have surpassed what may reasonably be expected based on the change in motor speed that was provided. This may also be an indicator that the sensor is not functioning as intended as well.

Further, the condition 106 may not necessarily involve an expectation that the change in data outputs from the sensor occurs immediately after the change in motor speed has been initiated. There may be an adjustment period before the sensor readings are expected to change as a consequence of the change in motor speed. Given this, the algorithm may allow a given period of time to elapse before the determination is made as to whether the sensor data has changed at all or has changed by a more specific, expected amount. This amount of time may simply be a predetermined period of time that is provided to the algorithm. However, the amount of time may also be specific and based on certain factors, such as the type of inducer blower, type of sensor, location of sensor relative to the inducer blower, and/or any other types of factors that might impact the amount of time that is expected to elapse before the sensor readings register non-negligible differences.

If it is determined that the data has changed, then the flow diagram 100 proceeds to operation 108. Operation 108 involves sending an indication to adjust the motor speed of the inducer blower back to the original value. That is, once the data being produced by the sensor is verified as being valid, the operation of the inducer blower, and the furnace as a whole, may be returned to operational conditions before the testing was initiated. In this manner, the furnace may be allowed to proceed to operate normally given that the sensor is producing valid data and there may be no malfunctions occurring in the sensor that was tested.

If it is determined, however, that the data still has not changed even after the adjustment is performed, then the flow diagram 100 proceeds to operation 110. Operation 110 involves sending a signal to turn off the furnace-controlled gas valve. In this instance, operation of the furnace is essentially ceased or paused given that the sensor is not producing valid data, which may lead to improper functioning of the furnace.

Additionally, in some cases, a notification may be provided to a user that the sensor is malfunctioning and the furnace has been turned off. For example, a notification may be sent to a device of a user, such as a smartphone or any other type of device. The notification may include any type of notification, such as an auditory, visual, text-based, and/or any other form of notification that may alert the user as to the malfunctioning sensor. The notification may also allow the user to contact a technician to replace or fix the sensor. A notification may also be automatically sent to a technician indicating that the sensor needs to be replaced or fixed. These examples are not intended to be limiting and notifications may also be sent to any other type of user to any type of device and in any form as well.

FIG. 2 illustrates an example of a system 200, in accordance with one or more embodiments of this disclosure. Particularly, the system 200 may illustrate an example configuration of a furnace including a sensor 212 that produces data that is verified by one or more controllers 222. The sensor 212 is also shown as sensor 304 in FIG. 3 (however this placement of the sensor 304 within a system 300, such as a furnace, is not intended to be limiting, and the sensor 304 may similarly be placed at any other location as well). The system 200 may include, for example, one or more gas valves 202, one or more gas nozzles 206, a heat exchanger 208, one or more inducer blowers 210, and/or one or more sensors 212. It should be noted that the components illustrated as being included within the system 200 may not necessarily represent all of the components that may be included in a furnace. That is, the system 200 may simply provide an example of high-level components to provide context for the algorithm used to verify the data produced by the sensor 212. The system 200 may also include any other number and or type of components and the illustration of the components included within the system 200 in FIG. 2 is not intended to be limiting. Reference may be made hereinafter to a single gas valve, gas nozzle, heat exchanger, inducer blower, and/or sensor. However, these descriptions may similarly apply to any other number of such components as well.

The furnace gas valve 202 is a component of the fuel system of the furnace. The furnace gas valve 202 may open and close, which may allow gas to flow to the gas nozzle 206. The gas nozzle 206 may receive the gas from the gas valve 202 and air that is fed into the furnace from the environment. This gas may be ignited by one or more igniters, which may cause combustion gases to be produced and routed through the heat exchanger 208.

The heat exchanger 208 is a component of the furnace that receives heat from the combustion gases created, in part, by the gas nozzle 206 that is produced as a result of the combustion process. The heat exchanger 208 may comprise a series of hollow metal tubes, through which the combustion gasses produced by the ignited gas and air mixture may flow. Once the heat exchanger 208 arrives at the proper temperature, a fan of the furnace (not shown in the figure) may turn on. The furnace may draw ambient temperature air from the environment and blow this air across the heat exchanger 208. The air that is blown across the heat exchanger 208 may be heated by the heat stored in the heat exchanger 208, which results in hot air being produced by the furnace and circulated through the environment (for example, through various ductwork). This provides the warm air into the environment that the furnace is intended to heat (for example, a residential home or a commercial space).

The inducer blower 210 (which may be a different element than the furnace blower that pushes air across the heat exchanger 208) turns on a period of time seconds before the furnace burners ignite and purges the heat exchanger of combustion gases that may have remained in that area during the furnace's previous heating cycle. This makes the air in the area cleaner at the time of combustion and also prevents furnace burners from becoming clogged with soot. The inducer blower 210 stays on while the furnace is in operation, providing a consistent flow of oxygen to the furnace, as well as enough air flow to pull the flame into the heat exchanger 208. By adjusting the amount air moving through the heat exchanger 208, the efficiency of the system may be improved. The inducer blower 210 is controlled by the one or more controllers 222. The inducer blower 210 is also shown as inducer blower 302 in FIG. 3 (however this placement of the inducer blower 302 within a system 300, such as a furnace, is not intended to be limiting, and the inducer blower 302 may similarly be placed at any other location as well).

The sensor 212 may measure data associated with the inducer blower 210. For example, the sensor 212 may include an inducer pressure transducer that captured data relating to the pressure generated by the inducer blower 210. However, the sensor 212 may also be any other type of sensor that may capture any other types of data as well. Additionally, the system 200 may include multiple sensors that capture various different types of data. The sensor 212 may generate either a digital or analog result. This result may be representative of air movement that the inducer blower 210 is creating.

The one or more controllers 222 may be configured to perform operations in association with the algorithm described herein. For example, the one or more controllers may be used to perform verification of any data that is produced by the sensor 212 (through module(s) 224, which may be the same as, or similar to, module(s) 426). In this manner, the one or more controllers 222 may include any of the components of the computing device(s) 500 described with respect to FIG. 5. That is, as illustrated in the figure, these elements may include one or more processor(s) 226, memory 228, and/or module(s) 224, as well as at least any other elements described as being included in the computing device(s) 500. That is, although the figure may only depict a particular element of system 200 as having one or more processors, memory, and one or more modules, this may not be intended to be limiting in any way.

Figure 4:
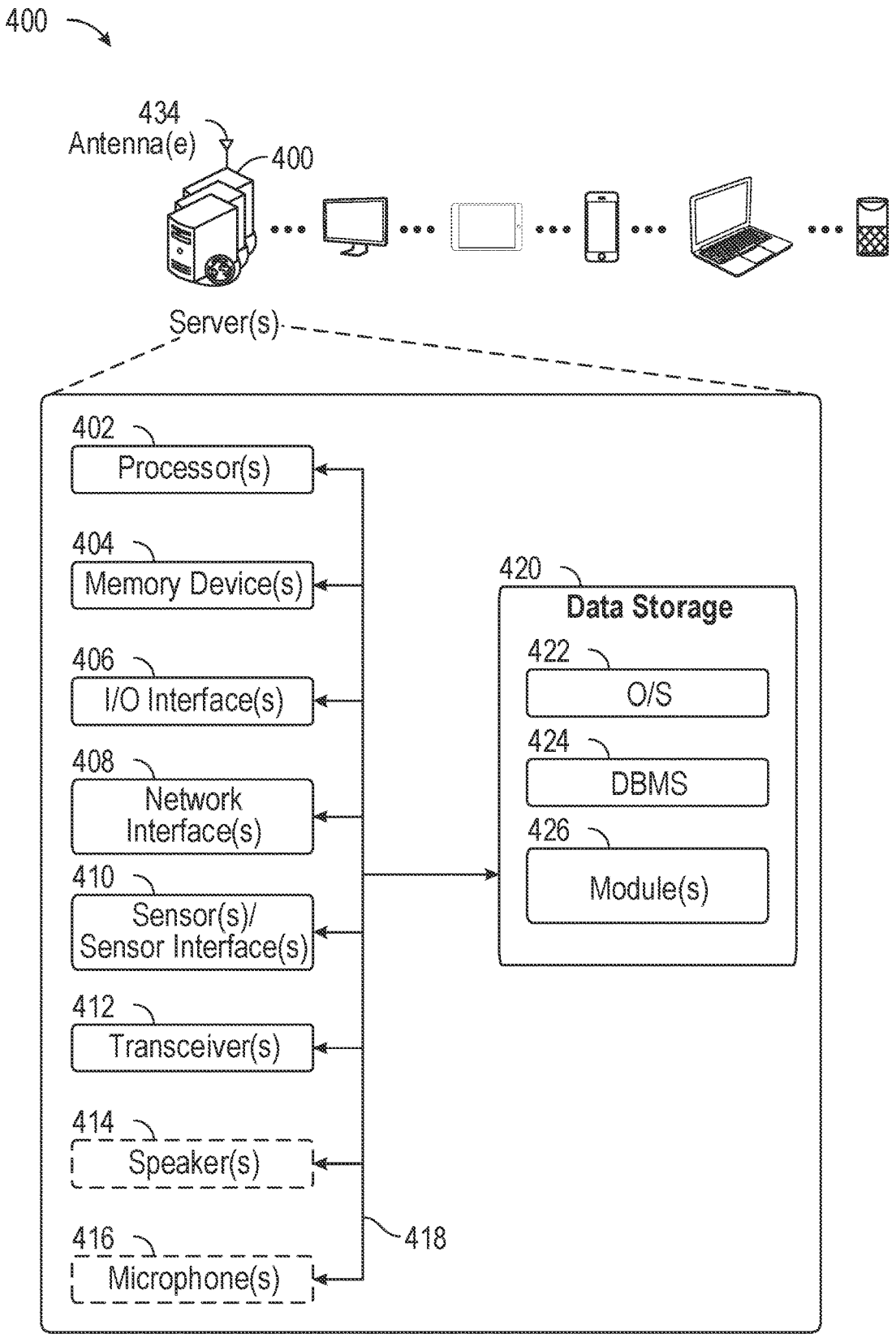
FIG. 4 is an example computer architecture, in accordance with one or more embodiments of the disclosure.

FIG. 4 illustrates an example method 400, in accordance with one or more examples of the disclosure. The method 400 may be performed by any of the controllers described herein (for example, controllers 222 illustrated in FIG. 2) and/or any other device and/or system described herein or otherwise.

At block 402, the method 400 may include receiving, from an inducer sensor, first data at a first time and second data at a second time. At block 404, the method 400 may include determining that a first difference between the first data and the second data is less than or equal to a threshold value. At block 406, the method 400 may include causing a motor speed of an inducer blower in the furnace system to adjust from a first speed to a second speed. At block 408, the method 400 may include receiving, from the inducer sensor, third data. At block 410, the method 400 may include determining that a second difference between the third data and the first data or the second data is less than or equal to the threshold value. At block 412, the method may include causing the furnace system to pause operation.

One or more operations of the methods, process flows, or use cases of FIGS. 1-4 may have been described above as being performed by a user device, or more specifically, by one or more program module(s), applications, or the like executing on a device. It should be appreciated, however, that any of the operations of the methods, process flows, or use cases of FIGS. 1-4 may be performed, at least in part, in a distributed manner by one or more other devices, or more specifically, by one or more program module(s), applications, or the like executing on such devices. In addition, it should be appreciated that processing performed in response to execution of computer-executable instructions provided as part of an application, program module, or the like may be interchangeably described herein as being performed by the application or the program module itself or by a device on which the application, program module, or the like is executing. While the operations of the methods, process flows, or use cases of FIGS. 1-4 may be described in the context of the illustrative devices, it should be appreciated that such operations may be implemented in connection with numerous other device configurations.

The operations described and depicted in the illustrative methods, process flows, and use cases of FIGS. 1-4 may be carried out or performed in any suitable order, such as the depicted orders, as desired in various example embodiments of the disclosure. Additionally, in certain example embodiments, at least a portion of the operations may be carried out in parallel. Furthermore, in certain example embodiments, less, more, or different operations than those depicted in FIGS. 1-4 may be performed.

Although specific embodiments of the disclosure have been described, one of ordinary skill in the art will recognize that numerous other modifications and alternative embodiments are within the scope of the disclosure. For example, any of the functionality and/or processing capabilities described with respect to a particular device or component may be performed by any other device or component. Further, while various illustrative implementations and architectures have been described in accordance with embodiments of the disclosure, one of ordinary skill in the art will appreciate that numerous other modifications to the illustrative implementations and architectures described herein are also within the scope of this disclosure.

Certain aspects of the disclosure are described above with reference to block and flow diagrams of systems, methods, apparatuses, and/or computer program products according to example embodiments. It will be understood that one or more blocks of the block diagrams and flow diagrams, and combinations of blocks in the block diagrams and the flow diagrams, respectively, may be implemented by execution of computer-executable program instructions. Likewise, some blocks of the block diagrams and flow diagrams may not necessarily need to be performed in the order presented, or may not necessarily need to be performed at all, according to some embodiments. Further, additional components and/or operations beyond those depicted in blocks of the block and/or flow diagrams may be present in certain embodiments.

Accordingly, blocks of the block diagrams and flow diagrams support combinations of means for performing the specified functions, combinations of elements or steps for performing the specified functions, and program instruction means for performing the specified functions. It will also be understood that each block of the block diagrams and flow diagrams, and combinations of blocks in the block diagrams and flow diagrams, may be implemented by special-purpose, hardware-based computer systems that perform the specified functions, elements or steps, or combinations of special-purpose hardware and computer instructions.

FIG. 5 is a schematic block diagram of one or more illustrative computing device(s) 500 in accordance with one or more example embodiments of the disclosure. The computing device(s) 500 may include any suitable computing device including, but not limited to, a server system, a mobile device such as a smartphone, a tablet, an e-reader, a wearable device, or the like; a desktop computer; a laptop computer; a content streaming device; a set-top box; or the like. The computing device(s) 500 may correspond to an illustrative device configuration for any of the computing systems described herein and/or any other system and/or device.

The computing device(s) 500 may be configured to communicate via one or more networks. Such network(s) may include, but are not limited to, any one or more different types of communications networks such as, for example, cable networks, public networks (e.g., the Internet), private networks (e.g., frame-relay networks), wireless networks, cellular networks, telephone networks (e.g., a public switched telephone network), or any other suitable private or public packet-switched or circuit-switched networks. Further, such network(s) may have any suitable communication range associated therewith and may include, for example, global networks (e.g., the Internet), metropolitan area networks (MANs), wide area networks (WANs), local area networks (LANs), or personal area networks (PANs). In addition, such network(s) may include communication links and associated networking devices (e.g., link-layer switches, routers, etc.) for transmitting network traffic over any suitable type of medium including, but not limited to, coaxial cable, twisted-pair wire (e.g., twisted-pair copper wire), optical fiber, a hybrid fiber-coaxial (HFC) medium, a microwave medium, a radio frequency communication medium, a satellite communication medium, or any combination thereof.

In an illustrative configuration, the computing device(s) 500 may include one or more processors (processor(s)) 502, one or more memory devices 504 (generically referred to herein as memory 504), one or more input/output (I/O) interfaces 506, one or more network interfaces 508, one or more sensors or sensor interfaces 510, one or more transceivers 512, one or more optional speakers 514, one or more optional microphones 516, and data storage 520. The computing device(s) 500 may further include one or more buses 518 that functionally couple various components of the computing device(s) 500. The computing device(s) 500 may further include one or more antenna(e) 534 that may include, without limitation, a cellular antenna for transmitting or receiving signals to/from a cellular network infrastructure, an antenna for transmitting or receiving WiFi signals to/from an access point (AP), a Global Navigation Satellite System (GNSS) antenna for receiving GNSS signals from a GNSS satellite, a Bluetooth antenna for transmitting or receiving Bluetooth signals, a Near Field Communication (NFC) antenna for transmitting or receiving NFC signals, and so forth. These various components will be described in more detail hereinafter.

The bus(es) 518 may include at least one of a system bus, a memory bus, an address bus, or a message bus, and may permit the exchange of information (e.g., data (including computer-executable code), signaling, etc.) between various components of the computing device(s) 500. The bus(es) 518 may include, without limitation, a memory bus or a memory controller, a peripheral bus, an accelerated graphics port, and so forth. The bus(es) 518 may be associated with any suitable bus architecture including, without limitation, an Industry Standard Architecture (ISA), a Micro Channel Architecture (MCA), an Enhanced ISA (EISA), a Video Electronics Standards Association (VESA) architecture, an Accelerated Graphics Port (AGP) architecture, a Peripheral Component Interconnect (PCI) architecture, a PCI-Express architecture, a Personal Computer Memory Card International Association (PCMCIA) architecture, a Universal Serial Bus (USB) architecture, and so forth.

The memory 504 of the computing device(s) 500 may include volatile memory (memory that maintains its state when supplied with power) such as random access memory (RAM) and/or non-volatile memory (memory that maintains its state even when not supplied with power) such as read-only memory (ROM), flash memory, ferroelectric RAM (FRAM), and so forth. Persistent data storage, as that term is used herein, may include non-volatile memory. In certain example embodiments, volatile memory may enable faster read/write access than non-volatile memory. However, in certain other example embodiments, certain types of non-volatile memory (e.g., FRAM) may enable faster read/write access than certain types of volatile memory.

In various implementations, the memory 504 may include multiple different types of memory such as various types of static random access memory (SRAM), various types of dynamic random access memory (DRAM), various types of unalterable ROM, and/or writeable variants of ROM such as electrically erasable programmable read-only memory (EEPROM), flash memory, and so forth. The memory 504 may include main memory as well as various forms of cache memory such as instruction cache(s), data cache(s), translation lookaside buffer(s) (TLBs), and so forth. Further, cache memory such as a data cache may be a multi-level cache organized as a hierarchy of one or more cache levels (L1, L2, etc.).

The data storage 520 may include removable storage and/or non-removable storage, including, but not limited to, magnetic storage, optical disk storage, and/or tape storage. The data storage 520 may provide non-volatile storage of computer-executable instructions and other data. The memory 504 and the data storage 520, removable and/or non-removable, are examples of computer-readable storage media (CRSM) as that term is used herein.

The data storage 520 may store computer-executable code, instructions, or the like that may be loadable into the memory 504 and executable by the processor(s) 502 to cause the processor(s) 502 to perform or initiate various operations. The data storage 520 may additionally store data that may be copied to the memory 504 for use by the processor(s) 502 during the execution of the computer-executable instructions. Moreover, output data generated as a result of execution of the computer-executable instructions by the processor(s) 502 may be stored initially in the memory 504, and may ultimately be copied to the data storage 520 for non-volatile storage.

More specifically, the data storage 520 may store one or more operating systems (O/S) 522; one or more database management systems (DBMS s) 524; and one or more program module(s), applications, engines, computer-executable code, scripts, or the like such as, for example, one or more data management module(s) 526, one or more data analysis module(s) 528, and/or one or more OBD module(s) 530. Some or all of these module(s) may be sub-module(s). Any of the components depicted as being stored in the data storage 520 may include any combination of software, firmware, and/or hardware. The software and/or firmware may include computer-executable code, instructions, or the like that may be loaded into the memory 504 for execution by one or more of the processor(s) 502. Any of the components depicted as being stored in the data storage 520 may support functionality described in reference to corresponding components named earlier in this disclosure.

The data storage 520 may further store various types of data utilized by the components of the computing device(s) 500. Any data stored in the data storage 520 may be loaded into the memory 504 for use by the processor(s) 502 in executing computer-executable code. In addition, any data depicted as being stored in the data storage 520 may potentially be stored in one or more datastore(s) and may be accessed via the DBMS 524 and loaded in the memory 504 for use by the processor(s) 502 in executing computer-executable code. The datastore(s) may include, but are not limited to, databases (e.g., relational, object-oriented, etc.), file systems, flat files, distributed datastores in which data is stored on more than one node of a computer network, peer-to-peer network datastores, or the like.

The processor(s) 502 may be configured to access the memory 504 and execute the computer-executable instructions loaded therein. For example, the processor(s) 502 may be configured to execute the computer-executable instructions of the various program module(s), applications, engines, or the like of the computing device(s) 500 to cause or facilitate various operations to be performed in accordance with one or more embodiments of the disclosure. The processor(s) 502 may include any suitable processing unit capable of accepting data as input, processing the input data in accordance with stored computer-executable instructions, and generating output data. The processor(s) 502 may include any type of suitable processing unit including, but not limited to, a central processing unit, a microprocessor, a reduced instruction set computer (RISC) microprocessor, a complex instruction set computer (CISC) microprocessor, a microcontroller, an application-specific integrated circuit (ASIC), a field-programmable gate array (FPGA), a system-on-a-chip (SoC), a digital signal processor (DSP), and so forth. Further, the processor(s) 502 may have any suitable microarchitecture design that includes any number of constituent components such as, for example, registers, multiplexers, arithmetic logic units, cache controllers for controlling read/write operations to cache memory, branch predictors, or the like. The microarchitecture design of the processor(s) 502 may be capable of supporting any of a variety of instruction sets.

Referring now to functionality supported by the various program module(s) depicted in FIG. 5, the module(s) 526 may include computer-executable instructions, code, or the like that responsive to execution by one or more of the processor(s) 502 may perform functions including, but not limited to, performing verification of any data produced by a sensor in accordance with the algorithm described herein, sending signals to various components of the furnace to perform functions in association with the verification of the data (for example, a signal to adjust a motor speed of the inducer blower), and/or any other functions described herein.

Referring now to other illustrative components depicted as being stored in the data storage 520, the O/S 522 may be loaded from the data storage 520 into the memory 504 and may provide an interface between other application software executing on the computing device(s) 500 and the hardware resources of the computing device(s) 500. More specifically, the O/S 522 may include a set of computer-executable instructions for managing hardware resources of the computing device(s) 500 and for providing common services to other application programs (e.g., managing memory allocation among various application programs). The O/S 522 may include any operating system now known or which may be developed in the future, including, but not limited to, any server operating system, any mainframe operating system, or any other proprietary or non-proprietary operating system.

The DBMS 524 may be loaded into the memory 504 and may support functionality for accessing, retrieving, storing, and/or manipulating data stored in the memory 504 and/or data stored in the data storage 520. The DBMS 524 may use any of a variety of database models (e.g., relational model, object model, etc.) and may support any of a variety of query languages. The DBMS 524 may access data represented in one or more data schemas and stored in any suitable data repository including, but not limited to, databases (e.g., relational, object-oriented, etc.), file systems, flat files, distributed datastores in which data is stored on more than one node of a computer network, peer-to-peer network datastores, or the like. In those example embodiments in which the computing device(s) 500 is a mobile device, the DBMS 524 may be any suitable lightweight DBMS optimized for performance on a mobile device.

Referring now to other illustrative components of the computing device(s) 500, the input/output (I/O) interface(s) 506 may facilitate the receipt of input information by the computing device(s) 500 from one or more I/O devices as well as the output of information from the computing device(s) 500 to one or more I/O devices. The I/O devices may include any of a variety of components such as a display or display screen having a touch surface or touchscreen; an audio output device for producing sound, such as a speaker; an audio capture device, such as a microphone; an image and/or video capture device, such as a camera; a haptic unit; and so forth. Any of these components may be integrated into the computing device(s) 500 or may be separate. The I/O devices may further include, for example, any number of peripheral devices such as data storage devices, printing devices, and so forth.

The I/O interface(s) 506 may also include an interface for an external peripheral device connection such as a universal serial bus (USB), FireWire, Thunderbolt, Ethernet port or other connection protocol that may connect to one or more networks. The I/O interface(s) 506 may also include a connection to one or more of the antenna(e) 534 to connect to one or more networks via a wireless local area network (WLAN) (such as WiFi) radio, Bluetooth, ZigBee, and/or a wireless network radio, such as a radio capable of communication with a wireless communication network such as a Long Term Evolution (LTE) network, WiMAX network, 3G network, etc.

The computing device(s) 500 may further include one or more network interface(s) 508 via which the computing device(s) 500 may communicate with any of a variety of other systems, platforms, networks, devices, and so forth. The network interface(s) 508 may enable communication, for example, with one or more wireless routers, one or more host servers, one or more web servers, and the like via one or more networks.

The antenna(e) 534 may include any suitable type of antenna depending, for example, on the communications protocols used to transmit or receive signals via the antenna (e) 534. Non-limiting examples of suitable antennae may include directional antennae, non-directional antennae, dipole antennae, folded dipole antennae, patch antennae, multiple-input multiple-output (MIMO) antennae, or the like. The antenna(e) 534 may be communicatively coupled to one or more transceivers 512 or radio components to which or from which signals may be transmitted or received.

As previously described, the antenna(e) 534 may include a cellular antenna configured to transmit or receive signals in accordance with established standards and protocols, such as Global System for Mobile Communications (GSM), 3G standards (e.g., Universal Mobile Telecommunications System (UMTS), Wideband Code Division Multiple Access (W-CDMA), CDMA2000, etc.), 4G standards (e.g., Long-Term Evolution (LTE), WiMax, etc.), direct satellite communications, or the like.

The antenna(e) 534 may additionally, or alternatively, include a WiFi antenna configured to transmit or receive signals in accordance with established standards and protocols, such as the IEEE 802.11 family of standards, including via 2.4 GHz channels (e.g., 802.11b, 802.11g, 802.11n), 5 GHz channels (e.g., 802.11n, 802.11ac), or 60 GHz channels (e.g., 802.11ad). In alternative example embodiments, the antenna(e) 534 may be configured to transmit or receive radio frequency signals within any suitable frequency range forming part of the unlicensed portion of the radio spectrum.

The antenna(e) 534 may additionally, or alternatively, include a GNSS antenna configured to receive GNSS signals from three or more GNSS satellites carrying time-position information to triangulate a position therefrom. Such a GNSS antenna may be configured to receive GNSS signals from any current or planned GNSS such as, for example, the Global Positioning System (GPS), the GLONASS System, the Compass Navigation System, the Galileo System, or the Indian Regional Navigational System.

The transceiver(s) 512 may include any suitable radio component(s) for—in cooperation with the antenna(e) 534—transmitting or receiving radio frequency (RF) signals in the bandwidth and/or channels corresponding to the communications protocols utilized by the computing device(s) 500 to communicate with other devices. The transceiver(s) 512 may include hardware, software, and/or firmware for modulating, transmitting, or receiving—potentially in cooperation with any of antenna(e) 534—communications signals according to any of the communications protocols discussed above including, but not limited to, one or more WiFi and/or WiFi direct protocols, as standardized by the IEEE 802.11 standards, one or more non-Wi-Fi protocols, or one or more cellular communications protocols or standards. The transceiver(s) 512 may further include hardware, firmware, or software for receiving GNSS signals. The transceiver(s) 512 may include any known receiver and baseband suitable for communicating via the communications protocols utilized by the computing device(s) 500. The transceiver(s) 512 may further include a low noise amplifier (LNA), additional signal amplifiers, an analog-to-digital (A/D) converter, one or more buffers, a digital baseband, or the like.

The sensor(s)/sensor interface(s) 510 may include or may be capable of interfacing with any suitable type of sensing device such as, for example, inertial sensors, force sensors, thermal sensors, and so forth. Example types of inertial sensors may include accelerometers (e.g., MEMS-based accelerometers), gyroscopes, and so forth.

The speaker(s) 514 may be any device configured to generate audible sound. The microphone(s) 516 may be any device configured to receive analog sound input or voice data.

It should be appreciated that the program module(s), applications, computer-executable instructions, code, or the like depicted in FIG. 5 as being stored in the data storage 520 are merely illustrative and not exhaustive and that processing described as being supported by any particular module may alternatively be distributed across multiple module(s) or performed by a different module. In addition, various program module(s), script(s), plug-in(s), application programming interface(s) (API(s)), or any other suitable computer-executable code hosted locally on the computing device(s) 500, and/or hosted on other computing device(s) accessible via one or more networks, may be provided to support functionality provided by the program module(s), applications, or computer-executable code depicted in FIG. 5 and/or additional or alternate functionality. Further, functionality may be modularized differently such that processing described as being supported collectively by the collection of program module(s) depicted in FIG. 5 may be performed by a fewer or greater number of module(s), or functionality described as being supported by any particular module may be supported, at least in part, by another module. In addition, program module(s) that support the functionality described herein may form part of one or more applications executable across any number of systems or devices in accordance with any suitable computing model such as, for example, a client-server model, a peer-to-peer model, and so forth. In addition, any of the functionality described as being supported by any of the program module(s) depicted in FIG. 5 may be implemented, at least partially, in hardware and/or firmware across any number of devices.

It should further be appreciated that the computing device(s) 500 may include alternate and/or additional hardware, software, or firmware components beyond those described or depicted without departing from the scope of the disclosure. More particularly, it should be appreciated that software, firmware, or hardware components depicted as forming part of the computing device(s) 500 are merely illustrative and that some components may not be present or additional components may be provided in various embodiments. While various illustrative program module(s) have been depicted and described as software module(s) stored in the data storage 520, it should be appreciated that functionality described as being supported by the program module(s) may be enabled by any combination of hardware, software, and/or firmware. It should further be appreciated that each of the above-mentioned module(s) may, in various embodiments, represent a logical partitioning of supported functionality. This logical partitioning is depicted for ease of explanation of the functionality and may not be representative of the structure of software, hardware, and/or firmware for implementing the functionality. Accordingly, it should be appreciated that functionality described as being provided by a particular module may, in various embodiments, be provided at least in part by one or more other module(s). Further, one or more depicted module(s) may not be present in certain embodiments, while in other embodiments, additional module(s) not depicted may be present and may support at least a portion of the described functionality and/or additional functionality. Moreover, while certain module(s) may be depicted and described as sub-module(s) of another module, in certain embodiments, such module(s) may be provided as independent module(s) or as sub-module(s) of other module(s).

Figure 3:
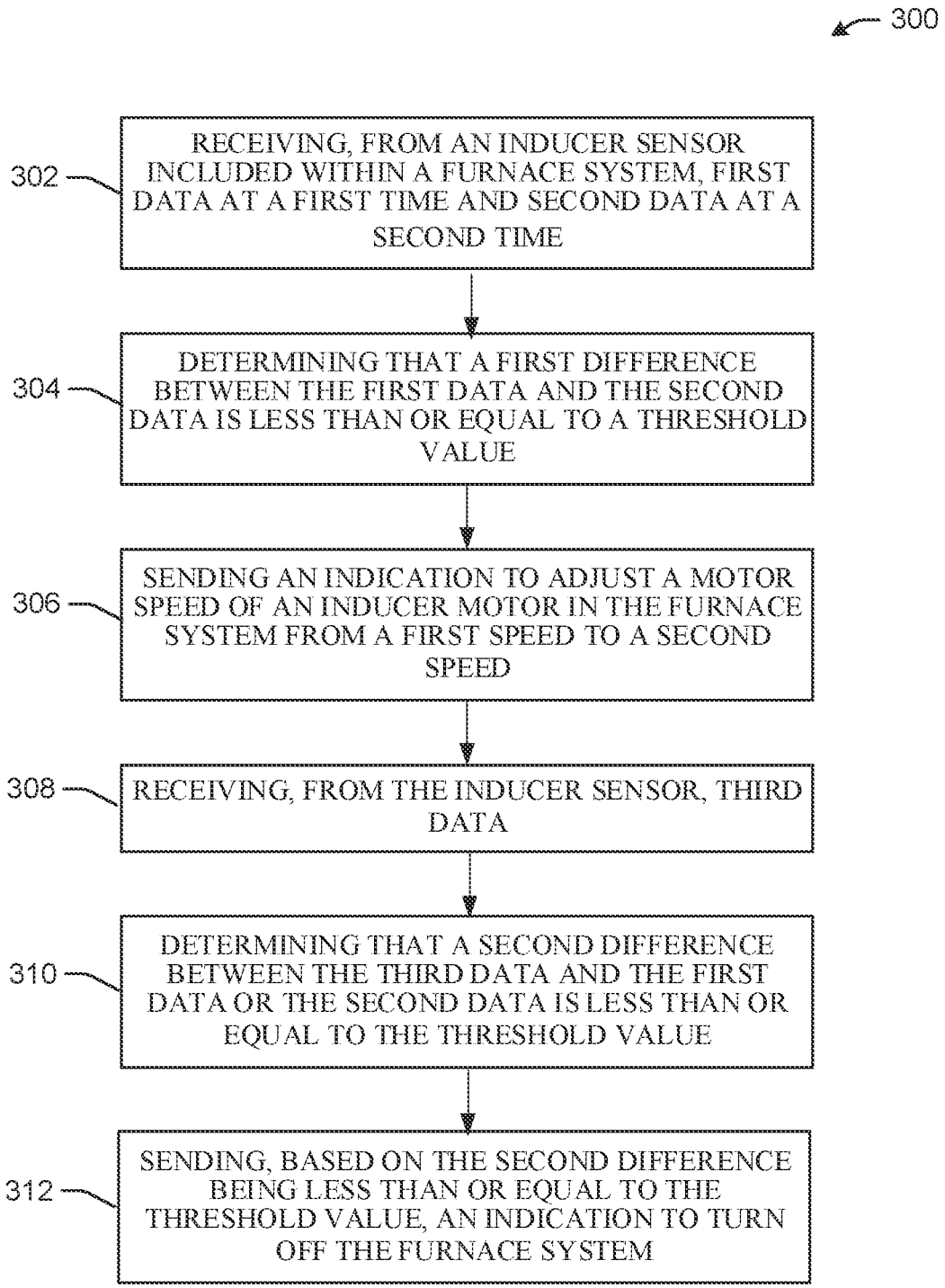
FIG. 3 is an example method for automated sensor output verification, in accordance with one or more embodiments of the disclosure.

One or more operations of the methods, process flows, and use cases of FIGS. 1-3 may be performed by a device having the illustrative configuration depicted in FIG. 5, or more specifically, by one or more engines, program module(s), applications, or the like executable on such a device. It should be appreciated, however, that such operations may be implemented in connection with numerous other device configurations.

Although specific embodiments of the disclosure have been described, one of ordinary skill in the art will recognize that numerous other modifications and alternative embodiments are within the scope of the disclosure. For example, any of the functionality and/or processing capabilities described with respect to a particular device or component may be performed by any other device or component. Further, while various illustrative implementations and architectures have been described in accordance with embodiments of the disclosure, one of ordinary skill in the art will appreciate that numerous other modifications to the illustrative implementations and architectures described herein are also within the scope of this disclosure.

Certain aspects of the disclosure are described above with reference to block and flow diagrams of systems, methods, apparatuses, and/or computer program products according to example embodiments. It will be understood that one or more blocks of the block diagrams and flow diagrams, and combinations of blocks in the block diagrams and the flow diagrams, respectively, may be implemented by execution of computer-executable program instructions. Likewise, some blocks of the block diagrams and flow diagrams may not necessarily need to be performed in the order presented, or may not necessarily need to be performed at all, according to some embodiments. Further, additional components and/or operations beyond those depicted in blocks of the block and/or flow diagrams may be present in certain embodiments.

Accordingly, blocks of the block diagrams and flow diagrams support combinations of means for performing the specified functions, combinations of elements or steps for performing the specified functions, and program instruction means for performing the specified functions. It will also be understood that each block of the block diagrams and flow diagrams, and combinations of blocks in the block diagrams and flow diagrams, may be implemented by special-purpose, hardware-based computer systems that perform the specified functions, elements or steps, or combinations of special-purpose hardware and computer instructions.

Program module(s), applications, or the like disclosed herein may include one or more software components, including, for example, software objects, methods, data structures, or the like. Each such software component may include computer-executable instructions that, responsive to execution, cause at least a portion of the functionality described herein (e.g., one or more operations of the illustrative methods described herein) to be performed.

A software component may be coded in any of a variety of programming languages. An illustrative programming language may be a lower-level programming language such as an assembly language associated with a particular hardware architecture and/or operating system platform. A software component comprising assembly language instructions may require conversion into executable machine code by an assembler prior to execution by the hardware architecture and/or platform.

Another example programming language may be a higher-level programming language that may be portable across multiple architectures. A software component comprising higher-level programming language instructions may require conversion to an intermediate representation by an interpreter or a compiler prior to execution.

Other examples of programming languages include, but are not limited to, a macro language, a shell or command language, a job control language, a script language, a database query or search language, or a report writing language. In one or more example embodiments, a software component comprising instructions in one of the foregoing examples of programming languages may be executed directly by an operating system or other software component without having to be first transformed into another form.

A software component may be stored as a file or other data storage construct. Software components of a similar type or functionally related may be stored together such as, for example, in a particular directory, folder, or library. Software components may be static (e.g., pre-established or fixed) or dynamic (e.g., created or modified at the time of execution).

Software components may invoke or be invoked by other software components through any of a wide variety of mechanisms. Invoked or invoking software components may comprise other custom-developed application software, operating system functionality (e.g., device drivers, data storage (e.g., file management) routines, other common routines, and services, etc.), or third-party software components (e.g., middleware, encryption, or other security software, database management software, file transfer or other network communication software, mathematical or statistical software, image processing software, and format translation software).

Software components associated with a particular solution or system may reside and be executed on a single platform or may be distributed across multiple platforms. The multiple platforms may be associated with more than one hardware vendor, underlying chip technology, or operating system. Furthermore, software components associated with a particular solution or system may be initially written in one or more programming languages, but may invoke software components written in another programming language.

Computer-executable program instructions may be loaded onto a special-purpose computer or other particular machine, a processor, or other programmable data processing apparatus to produce a particular machine, such that execution of the instructions on the computer, processor, or other programmable data processing apparatus causes one or more functions or operations specified in the flow diagrams to be performed. These computer program instructions may also be stored in a computer-readable storage medium (CRSM) that upon execution may direct a computer or other programmable data processing apparatus to function in a particular manner, such that the instructions stored in the computer-readable storage medium produce an article of manufacture including instruction means that implement one or more functions or operations specified in the flow diagrams. The computer program instructions may also be loaded onto a computer or other programmable data processing apparatus to cause a series of operational elements or steps to be performed on the computer or other programmable apparatus to produce a computer-implemented process.

Additional types of CRSM that may be present in any of the devices described herein may include, but are not limited to, programmable random access memory (PRAM), SRAM, DRAM, RAM, ROM, electrically erasable programmable read-only memory (EEPROM), flash memory or other memory technology, compact disc read-only memory (CD-ROM), digital versatile disc (DVD) or other optical storage, magnetic cassettes, magnetic tape, magnetic disk storage or other magnetic storage devices, or any other medium which can be used to store the information and which can be accessed. Combinations of any of the above are also included within the scope of CRSM. Alternatively, computer-readable communication media (CRCM) may include computer-readable instructions, program module(s), or other data transmitted within a data signal, such as a carrier wave, or other transmission. However, as used herein, CRSM does not include CRCM.

Although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

That which is claimed is:

1. A furnace system comprising:

one or more processors; and memory storing computer-executable instructions that, when executed by the one or more processors, cause the one or more processors to:

receive, from an inducer sensor, first data at a first time;

receive, from the inducer sensor, second data at a second time, wherein the second time is after the first time;

determine that a first difference between the first data and the second data is less than or equal to a threshold value;

cause a motor speed of an inducer blower in the furnace system to adjust from a first speed to a second speed;

receive, from the inducer sensor, third data;

determine that a second difference between the third data and the first data or the second data is less than or equal to the threshold value; and cause the furnace system to pause operation.

2. The furnace system of claim 1, wherein the computer-executable instructions further cause the one or more processors to:

receive, from the inducer sensor, fourth data;

determine that a third difference between the fourth data and the first data or the second data is less than or equal to the threshold value; and cause the motor speed to adjust from the second speed to the first speed.

3. The furnace system of claim 1, wherein the inducer sensor is a pressure transducer, and wherein the first data, second data, and third data include pressure generated by the inducer blower.

4. The furnace system of claim 1, wherein determining that the second difference between the third data and the first data or the second data is less than or equal to the threshold value is further based on a predetermined amount of time having elapsed since causing the motor speed to adjust from the first speed to the second speed.

5. The furnace system of claim 1, wherein the computer-executable instructions further cause the one or more processors to:

send, to a user device, a notification of a first sensor failure.

6. The furnace system of claim 5, wherein the computer-executable instructions further cause the one or more processors to:

determine, based on the first sensor failure, a prediction of a second failure of the inducer sensor; and send, to a user device, a notification of the prediction of the second failure of the inducer sensor.

7. The furnace system of claim 1, wherein the second speed is greater than the first speed and less than a threshold motor speed.

8. A method comprising:

receiving, from an inducer sensor of a furnace system, first data at a first time;

receiving, from the inducer sensor, second data at a second time, wherein the second time is after the first time;

determining that a first difference between the first data and the second data is less than or equal to a threshold value;

causing a motor speed of an inducer blower in the furnace system to adjust from a first speed to a second speed;

receiving, from the inducer sensor, third data;

determining that a second difference between the third data and the first data or the second data is less than or equal to the threshold value; and causing the furnace system to pause operation.

9. The method of claim 8, further comprising:

receiving, from the inducer sensor, fourth data;

determining that a third difference between the fourth data and the first data or the second data is less than or equal to the threshold value; and sending, based on the third difference being less than or equal to the threshold value, an indication to adjust the motor speed of the inducer blower back to the first speed.

10. The method of claim 8, wherein the inducer sensor is a pressure transducer, and wherein the first data, second data, and third data include pressure generated by the inducer blower.

11. The method of claim 8, wherein determining that the second difference between the third data and the first data or the second data is less than or equal to the threshold value is further based on a predetermined amount of time having elapsed since causing the motor speed to adjust from the first speed to the second speed.

12. The method of claim 8, further comprising:

sending, to a user device, a notification of a first sensor failure.

13. The method of claim 12, further comprising:

determining, based on the first sensor failure, a prediction of a second failure of the inducer sensor; and sending, to a user device, a notification of the prediction of the second failure of the inducer sensor.

14. A non-transitory computer-readable medium storing computer-executable instructions, that when executed by one or more processors, cause the one or more processors to perform operations comprising:

receiving, from an inducer sensor of a furnace system, first data at a first time;

receiving, from the inducer sensor, second data at a second time, wherein the second time is after the first time;

determining that a first difference between the first data and the second data is less than or equal to a threshold value;

causing a motor speed of an inducer blower in the furnace system to adjust from a first speed to a second speed;

receiving, from the inducer sensor, third data;

determining that a second difference between the third data and the first data or the second data is less than or equal to the threshold value; and causing the furnace system to pause operation.

15. The non-transitory computer-readable medium of claim 14, wherein the computer-executable instructions further cause the one or more processors to:

receive, from the inducer sensor, fourth data;

determine that a third difference between the fourth data and the first data or the second data is less than or equal to the threshold value; and send, based on the third difference being less than or equal to the threshold value, an indication to adjust the motor speed of the inducer blower back to the first speed.

16. The non-transitory computer-readable medium of claim 14, wherein the inducer sensor is a pressure transducer, and wherein the first data, second data, and third data include pressure generated by the inducer blower.

17. The non-transitory computer-readable medium of claim 14, wherein determining that the second difference between the third data and the first data or the second data is less than or equal to the threshold value is further based on a predetermined amount of time having elapsed since causing the motor speed to adjust from the first speed to the second speed.

18. The non-transitory computer-readable medium of claim 14, wherein the computer-executable instructions further cause the one or more processors to:

send, to a user device, a notification of a first sensor failure.

19. The non-transitory computer-readable medium of claim 18, wherein the computer-executable instructions further cause the one or more processors to:

determine, based on the first sensor failure, a prediction of a second failure of the inducer sensor; and send, to a user device, a notification of the prediction of the second failure of the inducer sensor.

20. The furnace system of claim 1, wherein the computer-executable instructions further cause the one or more processors to:

determine a plurality of sensor failures based on a plurality of data received from the inducer sensor; and send, to a user device, a notification that the inducer sensor requires replacement.

* * * * *